US006113161A

United States Patent [19]

Jung et al.

[11] Patent Number: 6,113,161

[45] Date of Patent: Sep. 5, 2000

[54] MOTOR VEHICLE DOOR LOCK, BONNET LOCK OR THE LIKE

[75] Inventors: Oliver Jung, Wuppertal; Siegfried Reichmann, Wermelskirchen; Bernd Allefeld, Breckerfeld; Bernd Weyerstall, Wuppertal; Berthold Huessler, Ahaus; Bernd Huster, Muenchberg; Hansjuergen Linde, Coburg; Uwe Neumann, Bamberg; Heinrich Plett, Wermelskirchen; Stefan Schwitters, Remscheid, all of Germany

[73] Assignee: Robert Bosch GmbH, Stuttgart, Germany

[21] Appl. No.: 09/147,579

[22] PCT Filed: Jun. 19, 1997

[86] PCT No.: PCT/DE97/01262

§ 371 Date: Jan. 26, 1999

§ 102(e) Date: Jan. 26, 1999

[87] PCT Pub. No.: WO98/04800

PCT Pub. Date: Feb. 5, 1998

[30] Foreign Application Priority Data

Jul. 26, 1996 [DE] Germany ..... 196 30 246

[51] Int. Cl.[7] ..... E05C 3/06

[52] U.S. Cl. ..... 292/216; 292/DIG. 23; 292/DIG. 43

[58] Field of Search ..... 292/216, DIG. 23, 292/DIG. 42, DIG. 43, 201

[56] References Cited

U.S. PATENT DOCUMENTS

| | | | |
|---|---|---|---|
| 3,409,321 | 11/1968 | Wolfslayer . | |
| 3,572,793 | 3/1971 | Cole . | |
| 3,614,146 | 10/1971 | Marx . | |
| 4,298,223 | 11/1981 | Raffelsiefer et al. | 292/216 |
| 4,334,704 | 6/1982 | Yamada | 292/216 |
| 4,783,102 | 11/1988 | Bernard | 292/216 |
| 4,948,184 | 8/1990 | Weyerstall et al. | 292/216 |
| 5,000,495 | 3/1991 | Wolfgang et al. | 292/216 |
| 5,118,146 | 6/1992 | Watanuki | 292/216 |
| 5,273,325 | 12/1993 | Zimmerman | 292/216 |
| 5,427,421 | 6/1995 | Hamaguchi | 292/216 |

FOREIGN PATENT DOCUMENTS

| | | |
|---|---|---|
| 0 406 777 | 1/1991 | European Pat. Off. . |
| 0 534 076 | 3/1993 | European Pat. Off. . |
| 19630245 | 1/1998 | Germany . |

*Primary Examiner*—Teri Pham

*Attorney, Agent, or Firm*—Sixbey, Friedman, Leedom & Ferguson; David S. Safran

[57] ABSTRACT

A motor vehicle door lock has a rotary latch with a holding recess formed in it. The rotary latch has a main catch with a catch surface formed on it. A key collar has a pin that is adapted to be received in the holding recess. A pivotally mounted detent pawl is biased in an engagement direction and has a catch lever having an opposing catch surface formed on it which is adapted to engage the catch surface of the main catch in a catch position. The catch lever and a support lever are pivotally mounted on an axle to pivot with respect to one another about an axis in the catch position in which the detent pawl is biased by a spring element into an extended position. An actuating element is disposed on the rotary latch, and the spring element cooperates with the actuating element to bias the detent pawl into the extended position when said actuating element engages the spring element. The rotary latch executes an overstroke when the motor vehicle door closes, and the spring element biases the detent pawl into the extended position prior to or during the overstroke.

12 Claims, 3 Drawing Sheets

MOTOR VEHICLE DOOR LOCK, BONNET LOCK OR THE LIKE

BACKGROUND OF THE INVENTION

The invention relates to a motor vehicle door lock, hood lock or the like.

The invention can be applied to motor vehicle door locks, motor vehicle hood locks, hatch locks, etc. and the definition of motor vehicle door lock should always be understood in this encompassing sense.

In convention motor vehicle door locks (as disclosed in German published application DE-A-29 36 977) the rotary latch made as a fork latch is pivotally mounted on a bearing journal and the tensioned or pressurized detent pawl is swivel-mounted around a detent pawl journal which is located parallel to the bearing journal. The detent pawl is made in one piece, strong and massive, and has a large-area opposing catch surface. The opposing catch surface executes an arc-shaped motion as soon as the detent pawl is actuated by lifting.

Safety aspects with the door closed for a crash have led not only to the rotary latch and the detent pawl being made very massive, but also to an undercut being located between the catch surface and the opposite catch surface (as disclosed in German published application DE-A-32 42 527). The larger the undercut angle, the greater the operating safety of the motor vehicle door lock in case of a crash.

The relatively large engagement depth of the opposing catch surface on the detent pawl into the catch surface on the rotary latch also contributes to increasing the operating safety of the motor vehicle door lock in case of a crash.

The increase of the operating safety of the motor vehicle door lock is achieved with considerable loss of ease of operation. Lifting of the detent pawl requires a large force.

The aforementioned problem was already recognized in the prior art and led to the one-part detent pawl having been replaced by a two-part detent pawl arrangement which can be bent in the middle (as disclosed in European published application EP-A-0 406 77; and German patent DE-C 41 02 049). There are also a large engagement depth and large undercut angle between the detent pawl and the rotary latch with the motor vehicle door closed with high operating safety of the motor vehicle door lock, nevertheless the lifting motion of the detent pawl requires relatively little force, since the detent pawl arrangement bends in the middle when the detent pawl is lifted and in this way the detent pawl executes, not pure arc motion around the detent pawl journal, but knuckle joint-like motion superimposed from arc motions.

In the aforementioned prior art from which the invention proceeds, a reduction of opening forces is achieved with high operating safety. The operating safety of the lock in the case of a crash or also during normal operation is greatly influenced by a second factor, specifically by the problem of false closing.

It has been found that existing classical rotary latches/detent pawl structures occasionally lead to false closing. This means that the detent pawl has therefore dropped only to a small extent, the engagement depth between the catch surface and opposing catch surface is therefore not fully used. The motor vehicle door seems to be closed, when vibration movements occur or in case of a crash however it bursts open unexpectedly. The aforementioned undercut between the detent pawl and rotary latch is also designed to avoid false closing. With the corresponding size of the undercut the catch surface and opposing catch surface act in the manner of a key mechanism. The reset force of a reset buffer which is often assigned to the rotary latch and which accommodates the over-stroke of the rotary latch is designed to lead to the opposing catch surface on the detent pawl being exposed to force from the catch surface on the rotary latch, such that the detent pawl is drawn into the full engagement depth in the main catch of the rotary latch.

It is obvious that the aforementioned measure for preventing false closing adversely affects the ease of opening of the motor vehicle door lock in the same way. Otherwise it is generally such that the ease of opening also suffers from the fact that the path which the detent pawl must traverse for complete lifting from the main catch of the rotary latch (or its forward catch) is rather large due to the large engagement depth between the catch surface and the opposing catch surface.

SUMMARY OF THE INVENTION

The teaching of this invention proceeding from the initially explained prior art underlies the object of developing the known motor vehicle door lock or the like such that false closing is prevented and thus operating safety is increased.

In the invention, the operating safety of the motor vehicle door lock or the like is increased by false closing being definitively precluded by forced coupling of the rotary latch with the detent pawl. The forced coupling, which cannot be considered allowable for reasons of emergency opening safety, is effected by the means of achieving the object as claimed in the invention only in a quite limited range of relative motion of the detent pawl and rotary latch, specifically during the over-stroke of the rotary latch. The additional spring action which occurs here on the knuckle joint-like detent pawl arrangement leads to the catch lever with its opposing catch surface being pressed into the catch surface on the rotary latch and complete engagement depth is reached with the active action of spring force. It is therefore then definitive such that the detent pawl has either not dropped at all or has dropped in a certain end state.

Otherwise, the transmission of force is distributed among several function surfaces where to date only one operating surface had to transfer force. This is known from the prior art (U.S. Pat. No. 3,572,793; EP-A-0 534 076), but can likewise be used in the invention to special advantage.

BRIEF DESCRIPTION OF THE DRAWING

In the following the invention is described in connection with the drawing in wherein.

DETAILED DESCRIPTION OF THE PREFERRED EMBODIMENT

Figure 1:
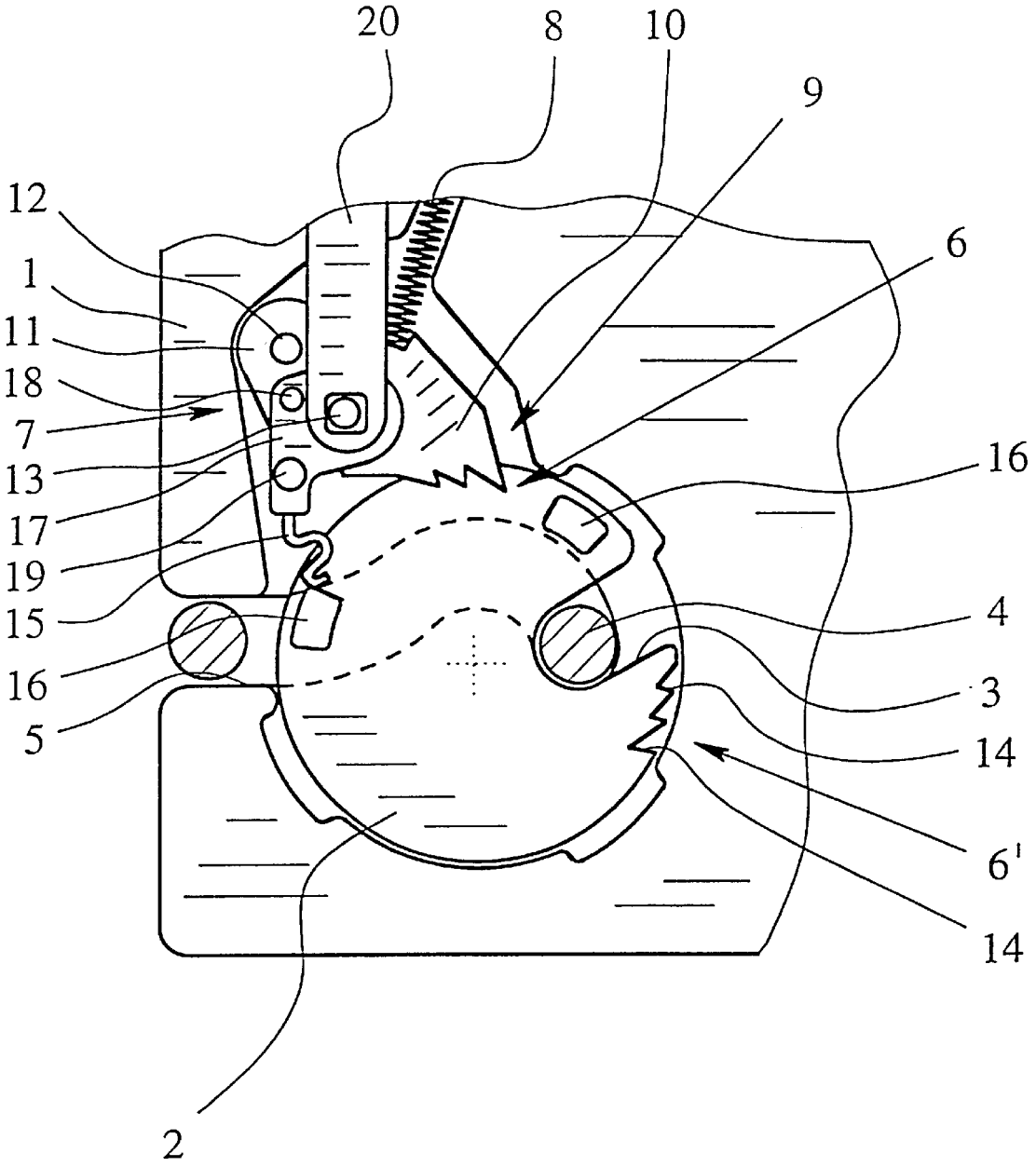
FIG. 1 shows in schematic form the area of the rotary latch and the detent pawl of a motor vehicle door lock of the invention.

FIG. 1 shows a motor vehicle door lock for the side door of a motor vehicle. Reference should be made to the statements at the start of the specification for the concept of motor vehicle door lock in the understanding of the teaching of this patent application.

Disposed in housing 1, are rotary latch 2 with holding recess 3 for the advance bridge or pin of key collar 4. Rotary latch 2 in this embodiment is disk-shaped, however it can also be made fork-shaped in the conventional manner within the framework of the invention. A disk-shaped rotary latch however as such is also prior art (as disclosed in German patent DE-C-16 78 121). Inlet slot 5 is provided in housing 1 for key collar 4. The special configuration of inlet slot 5 and rotary latch 2 in conjunction with a correspondingly configured key collar is the subject matter of the parallel as disclosed in German published application DE-A-196 30 245 of the applicant.

Rotary latch 2 on the main catch has catch surface 6. In this embodiment rotary latch 2 moreover has catch surface 6' also on a forward catch. For hood latches there are for example versions without a forward catch.

Pivotally mounted detent pawl 7 is prestressed by spring element 8 or the like in the engagement direction and has opposite catch surface 9 with which in the main catch or the forward catch it engages catch surface 6 on rotary latch 2 by blocking.

As described above, the motor vehicle door lock shown corresponds to the conventional standard for rotary latch 2 and detent pawl 7.

The embodiment shown is further characterized by a special configuration of detent pawl 7 which is feasible with respect to ease of opening, specifically by a knuckle joint-like structure. Detent pawl 7 is therefore made like a knuckle joint with catch lever 10 which bears opposite catch surface 9 and swivel mounted support lever 11 which are coupled via ajoint to hinged axle 13 parallel to swivel axis 12 to be able to bend against one another. In the catch position detent pawl 7 is tensioned under the action of spring force of spring element 8 into the extended position. In particular reference should be made to the initially explained prior art for the function of this detent pawl arrangement.

Conventionally it is such that rotary latch 2 when the motor vehicle door closes executes an over-stroke which goes slightly beyond the engagement position. In this embodiment a reset buffer which is not shown accommodates this over-stroke and sets rotary latch 2 back elastically into the final catch position in which then catch surface 6 and opposing catch surface 9 fully engage one another.

Figure 2:
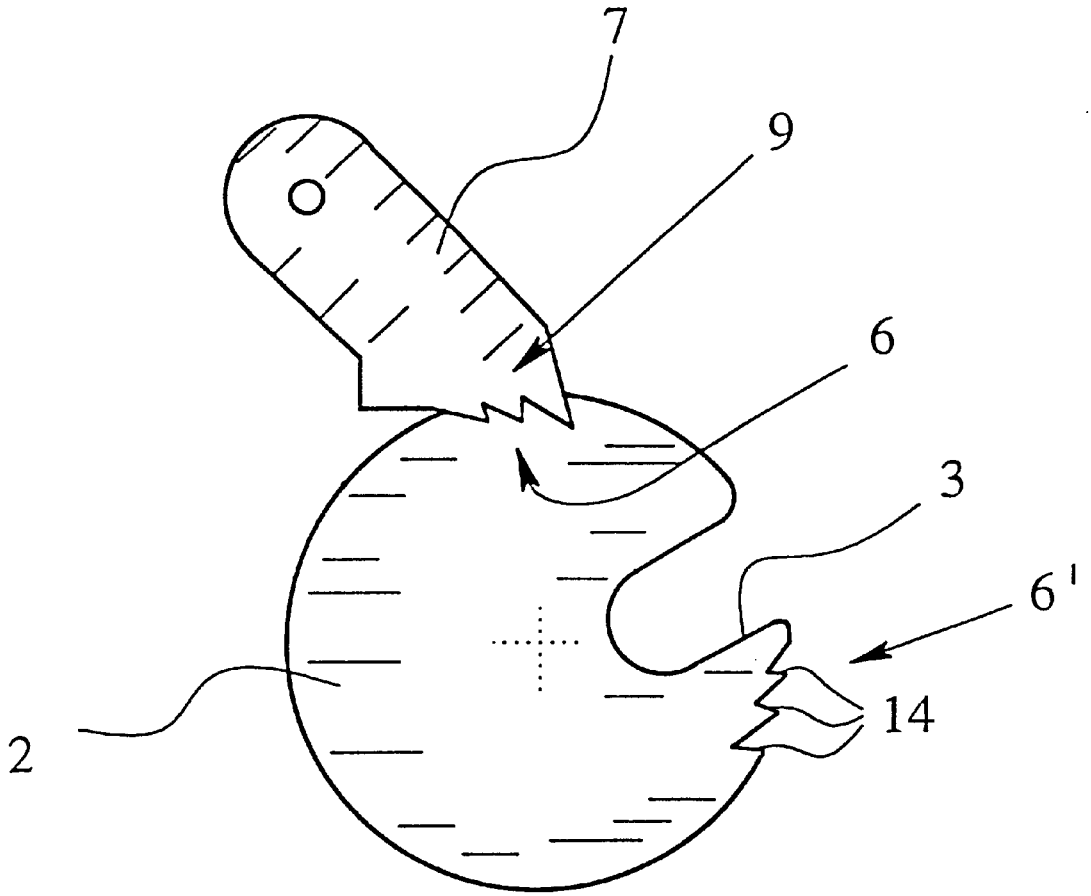
FIG. 2 shows enlarged the engagement area of the rotary latch and the detent pawl on the main catch in embodiment from FIG. 1.

FIG. 1 in conjunction with FIG. 2 makes it clear that here catch surface 6 on rotary latch 2 and opposing catch surface 9 on detent pawl 7 each are divided into a plurality of partial surfaces 14 which in the catch position engage one another. This has the advantages explained in the general part of the description.

This embodiment compared to the prior art clearly shows that partial surfaces 14 of catch surface 6 and opposing catch surface 9 have a very small engagement depth. In this case, in the preferred embodiment shown partial surfaces 14 are arranged in the manner of a sawtooth profile; at the same time this makes it clear that a correspondingly pronounced undercut is present here. The reason for a pronounced undercut has also been explained in the general part of the description.

If partial surfaces 14 are all made with the same engagement depth, all partial surfaces 14 always engage one another in the engagement position on the main catch or the forward catch. The advantage of a short raising path for detent pawl 7 and distribution of the forces which occur among several function surfaces have been explained above.

An additional safety function, which has in any case been partially improved, against false closing is acquired by the engagement depth on partial surfaces 14 being of different size. Feasibly the greatest engagement depth is achieved on frontmost partial surface 14 of detent pawl 7 or corresponding partial surface 14 on rotary latch 2. This means that partial surface 14 with the greatest engagement depth can engage partial surfaces 14 of smaller engagement depth and then force is transferred specifically in any case on one function surface so that false closing is prevented. With this partially reached catch position tearing forces in case of a crash may not be adequately accommodated, but in any case the motor vehicle door cannot easily spring open during normal driving. Ultimately, in addition to the forward catch other forward catch positions are "integrated" into the main catch and the forward catch.

Figure 3:
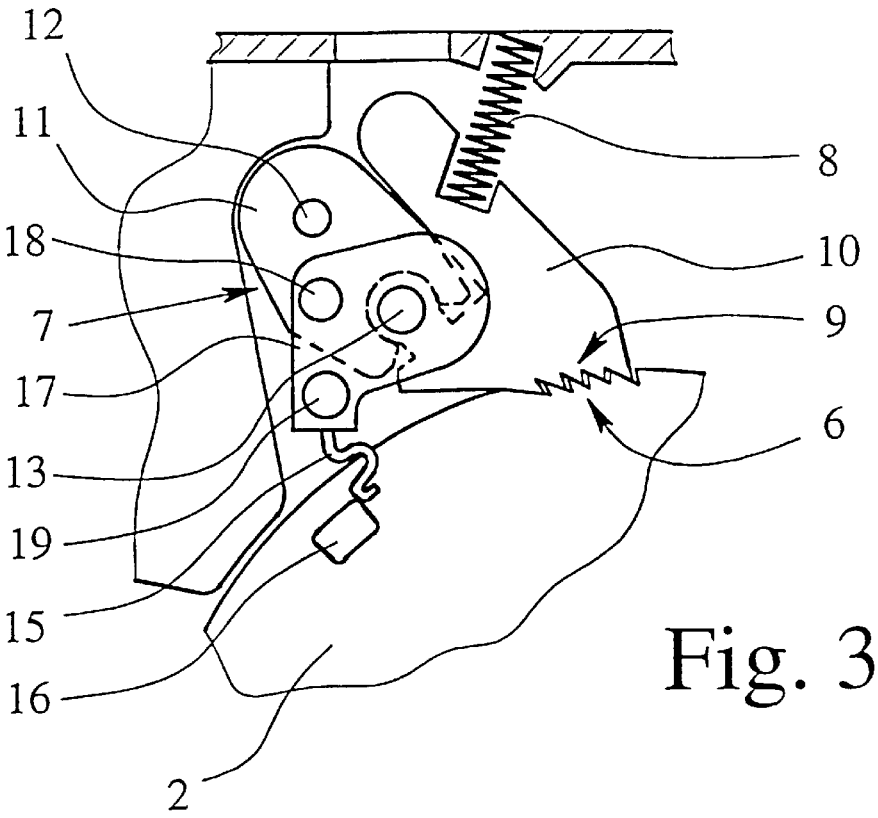
FIG. 3 shows the detent pawl arrangement of the detent pawl of the embodiment from FIG. 1 in an enlarged view without the action of the spring force of the additional spring element and FIG. 4 shows the detent pawl arrangement of the detent pawl of the embodiment from FIG. 1 in an enlarged view with the action of spring force of the additional spring element.
Figure 4:
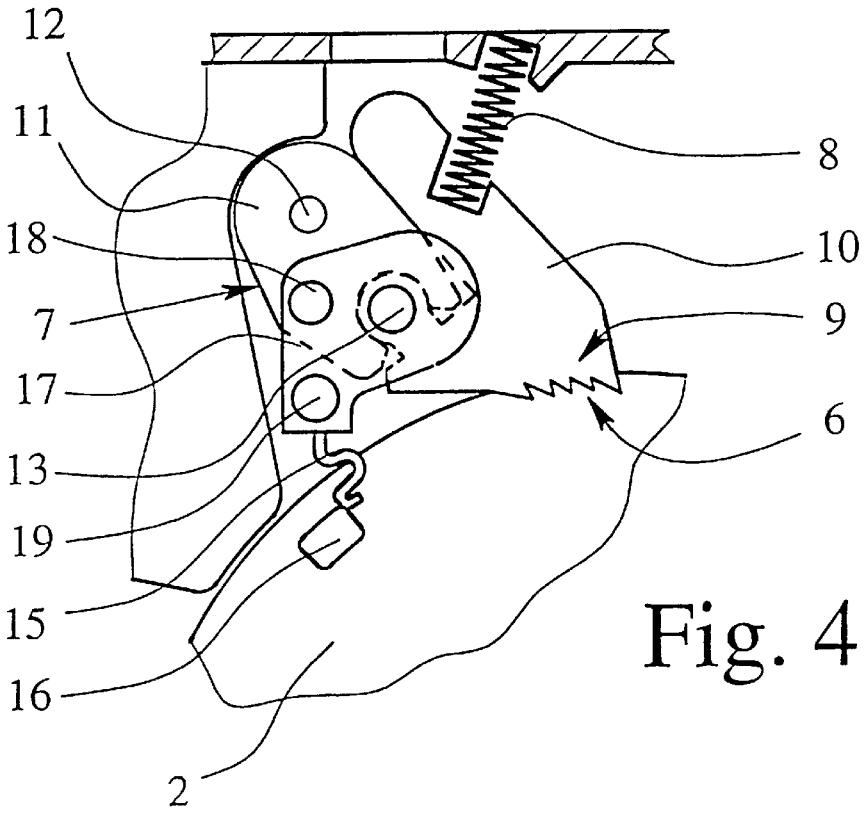

FIGS. 3 and 4 in conjunction with FIG. 1 show an especially feasible construction in which on detent pawl 7 there is additional spring element 15 which is tensioned by actuating element 16 assigned to the main catch on rotary latch 2 during the over-stroke of rotary latch 2, optionally beginning somewhat prior to the over-stroke of rotary latch 2, such that it applies spring force to detent pawl 7 in the bend direction. In this way catch lever 10 of detent pawl 7 with its opposite catch surface 9 or corresponding partial surfaces 14 is drawn into catch surface 6 on rotary latch 2. Additional spring element 15 however takes effect only during the end of motion of rotary latch 2 and is again deactivated entirely or for the most part after return of rotary latch 2 to the final catch position. This is shown by FIG. 3, while FIG. 4 shows the overstroke position of rotary latch 2.

In this embodiment it is provided that spring element 8 or the like engages catch lever 10 and additional spring element 15 engages support lever 11.

In this embodiment there is a special design such that additional spring element 15 with carrier 17 is attached to hinged axle 13 and second point 18 on support lever 11.

Finally, the Figures show that in this embodiment, actuation recess 16 is assigned to the forward catch on rotary latch 2 so that in the forward catch the desired effect, explained in detail above, occurs and prevents false closing with maximum possible safety.

This embodiment shows a plastic spring as additional spring element 15 which is attached to carrier 17 by means of fastening 19.

This embodiment shows pressure-loaded detent pawl 7, therefore a supporting detent pawl. The teaching of the invention can of course also be accomplished in the same way for a tension-loaded detent pawl.

Otherwise, the embodiment in FIG. 1 shows that hinged axle 13 is engaged by an actuating lever-trigger lever with which lifting motion can be executed for detent pawl 7. This is only one possibility of application of force to detent pawl 7; the prior art shows a plurality of other possibilities of engagement of mechanical and motor actuation.

What is claimed is:

1. A motor vehicle door lock, comprising:

a rotary latch having a holding recess formed therein, said rotary latch having a main catch with a catch surface formed thereon;

a key collar having a pin that is adapted to be received in said holding recess;

a pivotally mounted detent pawl biased in an engagement direction, said detent pawl comprising a catch lever having an opposing catch surface formed thereon which is adapted to engage said catch surface of said main catch in a catch position, and a support lever, said catch lever and said support lever being pivotally mounted on an axle to pivot with respect to one another about an axis, and in the catch position, said detent pawl being biased into an extended position by a spring element;

an actuating element disposed on said rotary latch;

wherein the spring element cooperates with said actuating element to bias said detent pawl into an extended position when said actuating element engages said spring element;

wherein said rotary latch executes an overstroke when the motor vehicle door closes and said spring element biases said detent pawl into the extended position prior to or during the overstroke.

2. A motor vehicle door lock as recited in claim 1, further comprising a forward catch formed on said rotary latch and having a forward catch surface formed thereon, said opposing catch surface being adapted to engage said forward catch in a forward catch position.

3. A motor vehicle door lock as recited in claim 2, wherein said actuating element corresponds to said forward catch.

4. A motor vehicle door lock as recited in claim 1, wherein said spring element is engaged with said support lever.

5. A motor vehicle door lock as recited in claim 1, wherein said spring element is disposed on a carrier, said carrier being mounted on said axle and being pivotally coupled to said support lever at a point not coinciding with said axle.

6. A motor vehicle door lock as recited in claim 1, wherein said catch surface and said opposing catch surface each comprise a plurality of partial surfaces which engage one another in the catch position.

7. A motor vehicle door lock as recited in claim 6, wherein said partial surfaces have a small engagement depth.

8. A motor vehicle door lock as recited in claim 6, wherein said partial surfaces are arranged in a sawtooth profile.

9. A motor vehicle door lock as recited in claim 6, wherein each partial surface of said catch surface engages a corresponding partial surface of said opposing catch surface.

10. A motor vehicle door lock as recited in claim 6, wherein the engagement depth on successive of said partial surfaces is different.

11. A motor vehicle door lock as recited in claim 10, wherein a frontmost of said partial surfaces of said opposing catch surface has the greatest engagement depth.

12. A motor vehicle door lock as recited in claim 6, each of said partial surfaces are undercut to a pronounced degree.

* * * * *